US007837741B2

(12) United States Patent
Kerpels et al.

(10) Patent No.: US 7,837,741 B2
(45) Date of Patent: Nov. 23, 2010

(54) DRY CLEANING METHOD

(75) Inventors: Fred Kerpels, Hoogvliet (NL); Joel A. Luckman, Benton Harbor, MI (US); Pieter E. Overdevest, Delft (NL); Tremitchell Wright, Elkhart, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 175 days.

(21) Appl. No.: 11/587,727

(22) PCT Filed: Apr. 12, 2005

(86) PCT No.: PCT/EP2005/003916

§ 371 (c)(1),
(2), (4) Date: Sep. 8, 2008

(87) PCT Pub. No.: WO2005/106105

PCT Pub. Date: Nov. 10, 2005

(65) Prior Publication Data

US 2009/0007345 A1 Jan. 8, 2009

(30) Foreign Application Priority Data

Apr. 29, 2004 (EP) ..... 04076305.4

(51) Int. Cl.
*D06L 1/02* (2006.01)

(52) U.S. Cl. ..... 8/142; 510/285; 8/137

(58) Field of Classification Search ..... 8/142; 510/285

See application file for complete search history.

(56) References Cited

U.S. PATENT DOCUMENTS

| | | | |
|---|---|---|---|
| 2,107,227 | A | 2/1938 | Woodin |
| D120,681 | S | 5/1940 | Sutton |
| 2,629,242 | A | 2/1953 | Hallander |
| 2,940,287 | A | 6/1960 | Henderson |
| 2,987,902 | A | 6/1961 | Mack |
| 3,085,415 | A | 4/1963 | Gosnell |
| 3,103,112 | A | 9/1963 | Behrens et al. |
| 3,114,919 | A | 12/1963 | Kenreich |
| 3,125,106 | A | 3/1964 | Brucken et al. |
| 3,163,028 | A | 12/1964 | De Pas et al. |
| 3,410,188 | A | 12/1964 | DePas et al. |
| 3,225,572 | A | 12/1965 | Robbins et al. |
| 3,232,335 | A | 2/1966 | Kalbfleisch |
| 3,234,660 | A | 2/1966 | Williams et al. |
| 3,246,493 | A | 4/1966 | Oles |
| 3,266,166 | A | 8/1966 | Heinrich |
| 3,269,539 | A | 8/1966 | Brucken et al. |
| 3,386,796 | A | 6/1968 | Videen |
| 3,402,576 | A | 9/1968 | Krupsky |
| 3,408,860 | A | 11/1968 | Knieriem et al. |
| 3,410,118 | A | 11/1968 | Dickey |
| 3,423,311 | A | 1/1969 | Hetherinton et al. |
| 3,477,259 | A | 11/1969 | Barnish et al. |
| 3,583,181 | A | 6/1971 | Brillet |
| 3,674,650 | A | 7/1972 | Fine |
| 3,683,651 | A | 8/1972 | Mazza |
| 3,691,649 | A | 9/1972 | Pigors |
| 3,733,267 | A | 5/1973 | Haase |
| 3,739,496 | A | 6/1973 | Buckley et al. |
| 3,765,580 | A | 10/1973 | Wilsker et al. |
| 3,809,924 | A | 5/1974 | Grunow et al. |
| 3,817,381 | A | 6/1974 | Heskett et al. |
| 3,861,179 | A | 1/1975 | Orchard |
| 3,915,808 | A | 10/1975 | Wilcox |
| 3,926,552 | A | 12/1975 | Bruckner |
| 3,930,998 | A | 1/1976 | Knopp et al. |
| 4,004,048 | A | 1/1977 | Jackson |
| 4,032,927 | A | 6/1977 | Goshima |
| 4,042,498 | A | 8/1977 | Kennedy |
| 4,045,174 | A | 8/1977 | Fuhring et al. |
| 4,046,700 | A | 9/1977 | Glover |
| 4,121,009 | A | 10/1978 | Chakrabarti |
| 4,153,590 | A | 5/1979 | Mueller |
| 4,154,003 | A | 5/1979 | Muller |
| 4,169,856 | A | 10/1979 | Cocuzza et al. |
| 4,184,950 | A | 1/1980 | Bixby |
| 4,186,047 | A | 1/1980 | Salmon |
| 4,223,029 | A | 9/1980 | Mahler et al. |
| 4,235,600 | A | 11/1980 | Capella |

(Continued)

FOREIGN PATENT DOCUMENTS

| | | |
|---|---|---|
| CN | 447090 | 11/1967 |

(Continued)

OTHER PUBLICATIONS

US 5,885,851 (withdrawn).

(Continued)

*Primary Examiner*—Harold Y Pyon
*Assistant Examiner*—Katie Hammer

(57) ABSTRACT

The present invention provides a safe method for cleaning fabric articles, comprising the step of treating the fabric articles with a working cyclosiloxane dry cleaning solvent to remove contaminants from the articles, wherein the working solvent is contacted and mixed with a solidifying catalyst in case of an increased temperature event. The present invention also provides a dry cleaning system suitable for carrying out the method of the invention. Since said method has improved safety, it is very suitable for in-home use.

24 Claims, 2 Drawing Sheets

U.S. PATENT DOCUMENTS

Figure 1:
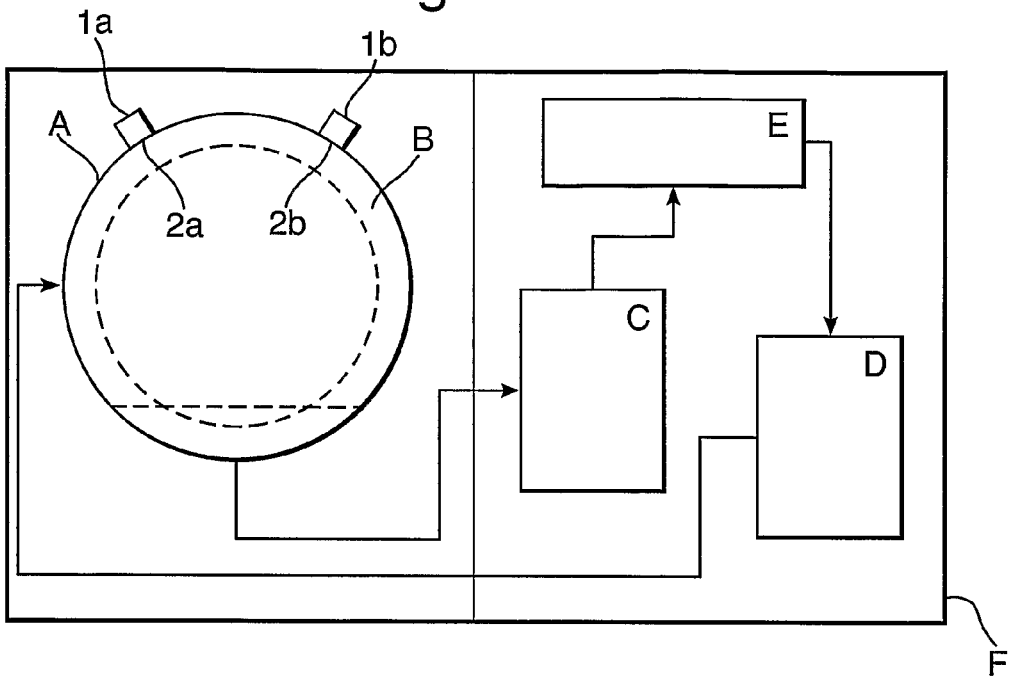

| | | | | |
|---|---|---|---|---|
| 4,247,330 | A | | 1/1981 | Sanders, Jr. |
| 4,252,546 | A | | 2/1981 | Krugmann |
| 4,319,973 | A | | 3/1982 | Porta et al. |
| 4,331,525 | A | | 5/1982 | Huba et al. |
| 4,345,297 | A | | 8/1982 | Check |
| 4,388,437 | A | | 6/1983 | Ona |
| 4,395,488 | A | | 7/1983 | Rowe |
| 4,420,398 | A | | 12/1983 | Castino |
| 4,421,794 | A | | 12/1983 | Kinsley, Jr. |
| 4,434,196 | A | | 2/1984 | Robinson et al. |
| 4,444,625 | A | | 4/1984 | Smith |
| 4,457,858 | A | | 7/1984 | Saran |
| 4,499,621 | A | | 2/1985 | Gasser |
| 4,513,590 | A | | 4/1985 | Fine |
| 4,539,093 | A | | 9/1985 | Friedman et al. |
| 4,595,506 | A | | 6/1986 | Kneer |
| 4,601,181 | A | | 7/1986 | Privat |
| 4,610,785 | A | | 9/1986 | Russell |
| 4,621,438 | A | | 11/1986 | Lanciaux |
| 4,622,039 | A | | 11/1986 | Merenda |
| 4,625,432 | A | | 12/1986 | Baltes |
| 4,636,328 | A | | 1/1987 | Flynn et al. |
| 4,664,754 | A | | 5/1987 | Caputi et al. |
| 4,665,929 | A | | 5/1987 | Helm |
| 4,678,587 | A | | 7/1987 | Voinche et al. |
| 4,682,424 | A | | 7/1987 | Irving |
| 4,685,930 | A | | 8/1987 | Kasprzak |
| 4,708,775 | A | | 11/1987 | McGregor et al. |
| 4,708,807 | A | | 11/1987 | Kemerer |
| 4,755,261 | A | | 7/1988 | McCord et al. |
| 4,761,209 | A | | 8/1988 | Bonaventura et al. |
| 4,767,537 | A | | 8/1988 | Davis |
| 4,769,921 | A | | 9/1988 | Kabakov |
| 4,790,910 | A | | 12/1988 | Havlik |
| 4,802,253 | A | | 2/1989 | Hagiwara |
| 4,808,319 | A | | 2/1989 | McNally et al. |
| 4,818,297 | A | | 4/1989 | Holzmiiller et al. |
| 4,830,710 | A | | 5/1989 | Thompson |
| 4,834,003 | A | | 5/1989 | Reischl et al. |
| 4,851,123 | A | | 7/1989 | Kmishra |
| 4,857,150 | A | | 8/1989 | Rival |
| 4,861,484 | A | * | 8/1989 | Lichtin et al. ..... 210/638 |
| 4,869,872 | A | | 9/1989 | Baltes |
| 4,879,888 | A | | 11/1989 | Suissa |
| 4,880,533 | A | | 11/1989 | Hondulas |
| 4,904,390 | A | | 2/1990 | Schweighofer et al. |
| 4,911,761 | A | | 3/1990 | McConnell |
| 4,912,793 | A | | 4/1990 | Hagiwara |
| 4,919,839 | A | | 4/1990 | Durbut |
| 4,947,983 | A | | 8/1990 | Jost |
| 4,961,753 | A | | 10/1990 | Donkers et al. |
| 4,980,030 | A | | 12/1990 | Johnson et al. |
| 4,984,318 | A | | 1/1991 | Coindreau-Palau |
| 4,999,398 | A | | 3/1991 | Graiver et al. |
| 5,004,000 | A | | 4/1991 | Berruex |
| 5,028,326 | A | | 7/1991 | Littler et al. |
| 5,043,075 | A | | 8/1991 | Dietmar et al. |
| 5,050,259 | A | | 9/1991 | Tsubaki |
| 5,054,210 | A | | 10/1991 | Schumacher |
| 5,056,174 | A | | 10/1991 | Hagiwara |
| 5,082,503 | A | | 1/1992 | Slugs |
| 5,091,105 | A | | 2/1992 | Madore et al. |
| 5,093,031 | A | | 3/1992 | Login et al. |
| 5,104,419 | A | | 4/1992 | Funk |
| 5,104,545 | A | | 4/1992 | Means et al. |
| 5,106,507 | A | | 4/1992 | Klock et al. |
| 5,112,358 | A | | 5/1992 | Deal |
| 5,116,426 | A | | 5/1992 | Asano et al. |
| 5,116,473 | A | | 5/1992 | Bostjancic |
| 5,118,322 | A | | 6/1992 | Wasinger et al. |
| 5,133,802 | A | | 7/1992 | Maekawa et al. |
| 5,135,656 | A | | 8/1992 | Means et al. |
| 5,143,579 | A | | 9/1992 | Field et al. |
| 5,146,693 | A | | 9/1992 | Dottor et al. |
| 5,151,026 | A | | 9/1992 | Anderson et al. |
| 5,154,854 | A | | 10/1992 | Zabotto et al. |
| 5,164,030 | A | | 11/1992 | Casper |
| 5,167,821 | A | | 12/1992 | Tanbo et al. |
| 5,173,200 | A | | 12/1992 | Kellett |
| 5,193,560 | A | | 3/1993 | Tanaka |
| 5,199,125 | A | | 4/1993 | Otto |
| 5,212,272 | A | | 5/1993 | Sargent et al. |
| 5,232,476 | A | | 8/1993 | Grant |
| 5,238,587 | A | | 8/1993 | Smith et al. |
| 5,240,507 | A | | 8/1993 | Gray |
| 5,248,393 | A | | 9/1993 | Schumacher et al. |
| 5,256,557 | A | | 10/1993 | Shetty et al. |
| 5,268,150 | A | | 12/1993 | Burkitt |
| 5,269,958 | A | | 12/1993 | de Jager |
| 5,273,589 | A | | 12/1993 | Griswold et al. |
| 5,284,029 | A | | 2/1994 | Keuper et al. |
| 5,287,985 | A | | 2/1994 | Hatayama |
| 5,288,420 | A | | 2/1994 | Mandy |
| 5,288,422 | A | | 2/1994 | Basu |
| 5,290,473 | A | | 3/1994 | Basu |
| 5,294,644 | A | | 3/1994 | Login et al. |
| 5,300,154 | A | | 4/1994 | Ferber et al. |
| 5,300,197 | A | | 4/1994 | Mitani et al. |
| 5,304,253 | A | | 4/1994 | Grant |
| 5,304,320 | A | | 4/1994 | Barthelemy et al. |
| 5,308,562 | A | | 5/1994 | Wohlfahrt-Laymann |
| 5,315,727 | A | | 5/1994 | Lee |
| 5,316,690 | A | | 5/1994 | Li |
| 5,320,683 | A | | 6/1994 | Samejima |
| 5,334,258 | A | | 8/1994 | Osano |
| 5,340,443 | A | | 8/1994 | Heinio et al. |
| 5,340,464 | A | | 8/1994 | Mickas |
| 5,342,405 | A | | 8/1994 | Duncan |
| 5,344,527 | A | | 9/1994 | Mickas |
| 5,345,637 | A | | 9/1994 | Pastryk et al. |
| 5,346,588 | A | | 9/1994 | Sixta et al. |
| 5,354,428 | A | | 10/1994 | Clark et al. |
| 5,354,480 | A | | 10/1994 | Robinson et al. |
| 5,360,547 | A | | 11/1994 | Cockett et al. |
| 5,368,649 | A | | 11/1994 | Tsukazaki |
| 5,377,705 | A | | 1/1995 | Smith |
| 5,392,480 | A | | 2/1995 | Ishihara |
| 5,404,732 | A | | 4/1995 | Kim |
| 5,405,542 | A | | 4/1995 | Trinh et al. |
| 5,405,767 | A | | 4/1995 | Shetty |
| 5,407,446 | A | | 4/1995 | Sando |
| 5,419,849 | A | | 5/1995 | Fields |
| 5,421,049 | A | | 6/1995 | Hendren |
| 5,423,921 | A | | 6/1995 | Saal |
| 5,426,955 | A | | 6/1995 | Modahl |
| 5,427,858 | A | | 6/1995 | Nakamura et al. |
| 5,431,827 | A | | 7/1995 | Tatch |
| 5,439,817 | A | | 8/1995 | Shetty et al. |
| 5,443,747 | A | | 8/1995 | Inada et al. |
| 5,447,171 | A | | 9/1995 | Shibano |
| 5,456,856 | A | | 10/1995 | Flaningam et al. |
| 5,460,018 | A | | 10/1995 | Werner |
| 5,461,742 | A | | 10/1995 | Pasad et al. |
| 5,463,819 | A | | 11/1995 | Komori |
| 5,467,492 | A | | 11/1995 | Chao et al. |
| 5,480,572 | A | | 1/1996 | Minor |
| 5,488,842 | A | | 2/1996 | Nishioka et al. |
| 5,490,894 | A | | 2/1996 | Matsuhisa |
| 5,492,138 | A | | 2/1996 | Taricco |
| 5,493,743 | A | | 2/1996 | Schneider |
| 5,494,526 | A | | 2/1996 | Paranjpe |
| 5,494,600 | A | | 2/1996 | Surutzidis et al. |
| 5,498,266 | A | | 3/1996 | Takagawa |
| 5,500,096 | A | | 3/1996 | Yuan |

5,501,811 A 3/1996 Flaningam et al.
5,503,681 A 4/1996 Inada
5,503,756 A 4/1996 Corona, III et al.
5,504,954 A 4/1996 Joo
5,505,985 A 4/1996 Nakamura et al.
5,511,264 A 4/1996 Nishioka et al.
5,518,624 A 5/1996 Filson et al.
5,524,358 A 6/1996 Matz
5,536,327 A 7/1996 Kaiser
5,536,374 A 7/1996 Spring
5,537,754 A 7/1996 Bachmann et al.
5,538,025 A 7/1996 Gray
5,538,746 A 7/1996 Levy
5,555,641 A 9/1996 Lee
5,574,975 A 11/1996 Hill
5,586,456 A 12/1996 Takagawa et al.
5,591,236 A 1/1997 Roetker
5,593,598 A 1/1997 McGinness et al.
5,604,145 A 2/1997 Hashizume et al.
5,605,882 A 2/1997 Klug et al.
5,617,737 A 4/1997 Christensen et al.
5,622,630 A 4/1997 Green et al.
5,625,965 A 5/1997 Blissett et al.
5,637,336 A 6/1997 Kannenberg et al.
5,639,031 A 6/1997 Wright et al.
5,644,158 A 7/1997 Fujii et al.
5,645,727 A 7/1997 Bhave et al.
5,649,785 A 7/1997 Djerf et al.
5,653,873 A 8/1997 Grossman
5,656,246 A 8/1997 Patapoff et al.
5,668,102 A 9/1997 Severns et al.
5,676,005 A 10/1997 Balliett
5,689,848 A 11/1997 Saal et al.
5,712,240 A 1/1998 Tyerech et al.
5,718,293 A 2/1998 Flynn et al.
5,759,209 A 6/1998 Adler
5,765,403 A 6/1998 Lincoln et al.
5,773,403 A 6/1998 Hijino et al.
5,776,351 A 7/1998 McGinness et al.
5,776,362 A 7/1998 Sato et al.
5,787,537 A 8/1998 Mannillo
5,789,368 A 8/1998 You et al.
5,799,612 A 9/1998 Page
5,806,120 A 9/1998 McEachem
5,814,498 A 9/1998 Mani et al.
5,814,592 A 9/1998 Kahn et al.
5,814,595 A 9/1998 Flynn et al.
5,824,632 A 10/1998 Flaningam et al.
5,827,812 A 10/1998 Flynn et al.
5,840,675 A 11/1998 Yeazell
5,846,435 A 12/1998 Haase
5,849,197 A 12/1998 Taylor et al.
5,852,942 A 12/1998 Sharp et al.
5,853,593 A 12/1998 Miller
5,858,240 A 1/1999 Tardowski et al.
5,865,851 A 2/1999 Sidoti et al.
5,865,852 A 2/1999 Berndt
5,868,937 A 2/1999 Back et al.
5,876,461 A 3/1999 Racette et al.
5,876,685 A 3/1999 Krulik et al.
5,883,067 A * 3/1999 Kubo et al. ..... 510/400
5,885,366 A 3/1999 Umino et al.
5,888,250 A 3/1999 Hayday et al.
5,893,979 A 4/1999 Held
5,894,061 A 4/1999 Ladouceur
5,904,737 A 5/1999 Preston et al.
5,906,750 A 5/1999 Haase
5,912,408 A 6/1999 Trinh et al.
5,914,041 A 6/1999 Chancellor
5,925,469 A 7/1999 Gee
5,925,611 A 7/1999 Flynn et al.
5,935,441 A 8/1999 O'Neill et al.
5,935,525 A 8/1999 Lincoln et al.
5,942,007 A 8/1999 Berndt et al.
5,954,869 A 9/1999 Elfersy et al.
5,955,394 A 9/1999 Kelly
5,958,240 A 9/1999 Hoel
5,959,014 A 9/1999 Liebeskind et al.
5,960,501 A 10/1999 Burdick
5,960,649 A 10/1999 Burdick
5,962,390 A 10/1999 Flynn et al.
5,972,041 A 10/1999 Smith et al.
5,977,040 A 11/1999 Inada et al.
5,985,810 A 11/1999 Inada et al.
6,006,387 A 12/1999 Cooper
6,010,621 A 1/2000 Pattee
6,013,683 A 1/2000 Myron
6,027,651 A 2/2000 Cash
6,029,479 A 2/2000 Pattee
6,042,617 A 3/2000 Berndt
6,042,618 A 3/2000 Berndt
6,045,588 A 4/2000 Estes et al.
6,053,952 A 4/2000 Kaiser
6,056,789 A 5/2000 Berndt
6,059,845 A 5/2000 Berndt
6,059,971 A 5/2000 Vit et al.
6,060,108 A 5/2000 Burd et al.
6,063,135 A 5/2000 Berndt et al.
6,063,748 A 5/2000 Flynn et al.
6,086,635 A 7/2000 Berndt et al.
6,098,306 A 8/2000 Ramsey
6,113,815 A 9/2000 Elfersy
6,115,862 A 9/2000 Cooper
6,120,587 A 9/2000 Elfersy
6,122,941 A 9/2000 McClain
6,136,223 A 10/2000 Collins
6,136,766 A 10/2000 Inada et al.
6,149,980 A 11/2000 Behr et al.
6,156,074 A 12/2000 Hayday et al.
6,159,376 A 12/2000 Lahti
6,159,917 A 12/2000 Baran
6,168,348 B1 1/2001 Weazell
6,168,714 B1 1/2001 Ilias et al.
6,171,346 B1 1/2001 Yeazell et al.
6,177,399 B1 1/2001 Mei et al.
6,190,556 B1 2/2001 Uhlinger
6,207,634 B1 3/2001 Meyer et al.
6,216,302 B1 4/2001 Preston et al.
6,217,771 B1 4/2001 Boyle et al.
6,221,944 B1 4/2001 Liebeskind
6,238,516 B1 5/2001 Watson et al.
6,238,736 B1 5/2001 Smith
6,239,097 B1 5/2001 Wilson
6,241,779 B1 6/2001 Collins
6,241,786 B1 6/2001 Zarges et al.
6,254,838 B1 7/2001 Goede
6,254,932 B1 7/2001 Smith
6,258,130 B1 7/2001 Murphy
6,258,276 B1 7/2001 Mika et al.
6,261,460 B1 7/2001 Benn et al.
6,269,667 B1 8/2001 Back
6,273,919 B1 8/2001 Hayday
6,274,540 B1 8/2001 Scheibel et al.
6,277,804 B1 8/2001 Kahn et al.
6,281,187 B1 8/2001 Smerznak
6,288,018 B1 9/2001 Flynn et al.
6,299,779 B1 10/2001 Pattee
6,309,425 B1 10/2001 Murphy
6,309,752 B1 10/2001 Dams et al.
6,310,029 B1 10/2001 Kilgour et al.
6,312,476 B1 11/2001 Perry et al.
6,312,528 B1 11/2001 Summerfield et al.
6,319,406 B1 11/2001 Freshour et al.
6,327,731 B2 12/2001 Back
6,334,340 B1 1/2002 Kegler et al.
6,348,441 B1 2/2002 Aiken et al.

6,350,377 B1 2/2002 Kollmar et al.
6,365,051 B1 4/2002 Bader
6,368,359 B1 * 4/2002 Perry et al. ..... 8/142
6,379,547 B1 4/2002 Larsson
6,384,008 B1 5/2002 Parry
6,387,186 B1 5/2002 Reisig et al.
6,387,241 B1 5/2002 Murphy et al.
6,398,840 B1 6/2002 Orta-Castro et al.
6,399,357 B1 6/2002 Winge
6,402,956 B1 6/2002 Andou et al.
6,416,668 B1 7/2002 Al-Samadi
6,423,230 B2 7/2002 Ilias et al.
6,451,066 B2 9/2002 Estes et al.
6,475,968 B1 11/2002 Murphy et al.
6,479,719 B1 11/2002 Kotwica et al.
6,497,921 B1 12/2002 Carbonell
6,552,090 B1 4/2003 Behr et al.
6,558,432 B2 5/2003 Schulte et al.
6,578,225 B2 6/2003 Jonsson
6,591,638 B2 7/2003 Estes et al.
6,653,512 B1 11/2003 Behr et al.
6,670,317 B2 12/2003 Severns et al.
6,691,536 B2 * 2/2004 Severns et al. ..... 68/12.27
6,734,153 B2 5/2004 Scheper
6,736,859 B2 5/2004 Racette et al.
6,743,262 B1 6/2004 Behr et al.
6,746,617 B2 6/2004 Radomyselski et al.
6,755,871 B2 6/2004 Damaso et al.
6,766,670 B2 7/2004 Estes et al.
6,770,615 B1 8/2004 Aouad et al.
6,811,811 B2 11/2004 France et al.
6,828,292 B2 12/2004 Noyes et al.
6,828,295 B2 12/2004 Deak et al.
6,840,069 B2 1/2005 France et al.
6,855,173 B2 2/2005 Ehrnsperger et al.
6,860,108 B2 3/2005 Soechting et al.
6,860,998 B1 3/2005 Wilde
6,890,892 B2 5/2005 Scheper et al.
6,894,014 B2 5/2005 Deak et al.
6,898,951 B2 5/2005 Severns et al.
7,033,985 B2 4/2006 Noyes et al.
7,390,563 B2 6/2008 Kadoya
2001/0042275 A1 11/2001 Estes et al.
2001/0054202 A1 12/2001 Severns et al.
2002/0004950 A1 1/2002 Burns et al.
2002/0004952 A1 1/2002 Deak et al.
2002/0004995 A1 1/2002 Ammat et al.
2002/0007519 A1 1/2002 Noyes et al.
2002/0010964 A1 1/2002 Deak et al.
2002/0010965 A1 1/2002 Schulte et al.
2002/0013234 A1 1/2002 Severns et al.
2002/0017493 A1 2/2002 Ehrnsperger et al.
2002/0019323 A1 2/2002 Bargaje
2002/0029427 A1 3/2002 Severns et al.
2002/0038480 A1 4/2002 Deak et al.
2002/0056163 A1 5/2002 Estes
2002/0056164 A1 5/2002 Estes et al.
2002/0110926 A1 8/2002 Kopf-Sill et al.
2002/0133885 A1 9/2002 Noyes et al.
2002/0133886 A1 9/2002 Severns et al.
2003/0037809 A1 2/2003 Favaro
2003/0046963 A1 3/2003 Scheper et al.
2003/0070238 A1 4/2003 Radomyselski et al.
2003/0080467 A1 5/2003 Andrews
2003/0084588 A1 5/2003 France et al.
2003/0092592 A1 5/2003 Bargaje et al.
2003/0097718 A1 5/2003 Evers et al.
2003/0196277 A1 10/2003 Hallman et al.
2003/0196282 A1 10/2003 Fyvie et al.
2003/0204917 A1 11/2003 Estes et al.
2003/0226214 A1 12/2003 Radomyselski et al.
2003/0227394 A1 12/2003 Rothgeb
2004/0045096 A1 3/2004 Mani et al.
2004/0088795 A1 5/2004 Orchowski et al.
2004/0088846 A1 5/2004 Murphy et al.
2004/0117919 A1 6/2004 Conrad et al.
2004/0117920 A1 6/2004 Fyvie et al.
2004/0129032 A1 7/2004 Luckman et al.
2004/0139555 A1 7/2004 Conrad
2005/0000897 A1 1/2005 Radomyselski et al.
2005/0037938 A1 2/2005 Elhamid et al.
2005/0043196 A1 2/2005 Wright et al.
2005/0071928 A1 4/2005 Wright et al.
2005/0076453 A1 4/2005 Lucas et al.
2005/0091755 A1 5/2005 Conrad et al.
2005/0091756 A1 5/2005 Wright
2005/0091757 A1 5/2005 Luckman et al.
2005/0092033 A1 5/2005 Luckman et al.
2005/0092352 A1 5/2005 Luckman et al.
2005/0096242 A1 5/2005 Luckman et al.
2005/0096243 A1 5/2005 Luckman et al.
2005/0126606 A1 6/2005 Goedhart
2005/0132502 A1 6/2005 Goldoni
2005/0133462 A1 6/2005 Goldoni
2005/0150059 A1 7/2005 Luckman et al.
2005/0155393 A1 7/2005 Wright et al.
2005/0183208 A1 8/2005 Scheper et al.
2005/0187125 A1 8/2005 Deak et al.
2005/0222002 A1 10/2005 Luckman et al.
2005/0224099 A1 10/2005 Luckman et al.
2005/0257812 A1 11/2005 Wright et al.
2005/0263173 A1 12/2005 Luckman et al.
2006/0260064 A1 11/2006 Luckman et al.
2006/0260065 A1 11/2006 Wright et al.

FOREIGN PATENT DOCUMENTS

DE 4319177 2/1994
DE 4343488 6/1995
DE 4343488 A1 6/1995
DE 60116093 8/2006
DE 60116093 A 8/2006
EP 0182583 11/1985
EP 0246007 3/1992
EP 0623389 11/1994
EP 0707060 7/1998
EP 1041189 10/2000
EP 1290259 3/2003
EP 1528138 10/2004
EP 1528139 10/2004
EP 1528140 10/2004
EP 1528141 10/2004
EP 1536052 10/2004
GB 1002318 8/1965
GB 2238793 A * 6/1991
JP 59006944 10/1975
JP 1236303 9/1989
JP 1236303 A 9/1989
JP 5064521 A 3/1993
JP 6233898 8/1994
JP 006233898 8/1994
JP 2002114089 4/2002
JP 2003307386 10/2003
WO WO 98/06815 2/1998
WO WO 98/06818 2/1998
WO WO 98/29595 7/1998
WO WO 99/14175 3/1999
WO WO 00/04222 1/2000
WO WO 0104221 1/2000
WO WO0042689 7/2000
WO WO 01/06051 1/2001
WO WO 01/06054 1/2001
WO WO 01/13461 2/2001
WO WO 01/34613 5/2001
WO WO 01/44256 6/2001
WO WO 01/48297 7/2001

| | | |
|---|---|---|
| WO | WO 01/94675 | 12/2001 |
| WO | WO 01/94677 | 12/2001 |
| WO | WO 01/94680 | 12/2001 |
| WO | WO 01/94683 | 12/2001 |
| WO | WO 01/94685 | 12/2001 |
| WO | WO 01/94690 | 12/2001 |
| WO | WO 2005/019517 | 3/2005 |

OTHER PUBLICATIONS

The Advantages and Drawbacks of Introducing Community-wide Restrictions on the Marketing & Use of 2-(2-butoxyethoxy) ethanol (DEGBE); European Commission Directorate-General; Oct. 29, 2001.

* cited by examiner

DRY CLEANING METHOD

FIELD OF THE INVENTION

The present invention relates to a dry cleaning method for cleaning fabric articles, wherein the articles are treated with a working cyclosiloxane dry cleaning solvent to remove contaminants from said articles, and wherein special measures are taken in case of an increased temperature event. The present invention also relates to a dry cleaning system for cleaning fabric articles suitable for applying the method of the invention, said system comprising a reservoir containing a working cyclosiloxane dry cleaning solvent, and a vessel for treating fabric articles. The system of the invention comprises, optionally, also a reclamation device for cleaning-up the used solvent formed during treatment of the fabric articles.

Preferably, the dry cleaning method and system of the invention are suitable for in-home use.

BACKGROUND OF THE INVENTION

In general, fabric articles can be cleaned using water as the primary medium with, additionally, surfactants and other cleaning agents for enhancing the cleaning performance.

However, some laundry articles cannot be safely cleaned with water. For these, a dry cleaning process may be used wherein a cyclosiloxane dry cleaning solvent is the primary medium. Dry cleaning is, however, only available in specialised outlets and, usually, consumers have to bring and pick up their clothes, which is not convenient.

In this connection, some proposals have been made towards an in-home dry cleaning process, i.e. a dry cleaning process for relatively small wash loads suitable for use in domestic environments.

However, the use of organic cyclosiloxane dry cleaning solvent in domestic environments requires a more stringent approach regarding safety and ease of use.

Domestic environments are usually well adapted for aqueous washing; water is available from a tap and can be discharged to a sewer after washing. Evidently, this will be more complicated with cyclosiloxane dry cleaning solvents. Fresh solvent needs to be supplied to replenish lost solvent. The supply of fresh solvent will probably be carried out via cylinders which need to be purchased separately from time to time. Furthermore, for environmental and safety reasons the dry cleaning machine will probably have to be designed as a closed system. This is to retain substantially all of the solvent so as to minimise losses into the environment. In addition, the whole process of adding fresh solvent and collecting used solvent will also have to meet such stringent environmental and safety requirements.

Various dry cleaning systems are known in the art.

For instance, WO-A-01/94678 discloses fabric article treatment processes to be carried out in a domestic appliance, which may preferably include a washing step wherein a lipophilic cleaning fluid, such as a siloxane, is present as the predominant fluid. However, this document does not disclose appliances or machines that incorporate effective safety measures, in particular safety measures that reduce the risk involved when using lipophilic fluids having a flash point, such as cyclosiloxanes.

Another type of dry cleaning system is disclosed in WO-A-01/94675. This document describes a dry cleaning apparatus and method for fabric treatment, that are safe for a wide range of fabric articles, minimise shrinkage and wrinkling, and can be adapted to a cost-effective use in the consumer's home. In said method a lipophilic cleaning fluid is used, which can include linear and cyclic polysiloxanes, hydrocarbons and chlorinated hydrocarbons. Preferred lipophilic solvents are non-viscous, and include cyclic siloxanes having a boiling point at 760 mmHg of below 250° C.

However, it has been found to be less safe to use a non-viscous cyclosiloxane dry cleaning solvent under all circumstances. For practical reasons it is indeed desirable to use a non-viscous cyclosiloxane dry cleaning solvent having a viscosity of no more than about 5 cSt under normal operating conditions. Under high-risk conditions, however, it is less safe to operate a dry cleaning system comprising a solvent with a viscosity of no more than about 10 cSt.

Furthermore, US-A-2003/0226214 discloses a dry cleaning system containing a solvent filtration device and a method for using this system. The lipophilic solvent used herein is preferably inflammable. It is also preferred that said solvent has a relatively high flash point and/or a relatively low volatile organic compound (VOC) characteristic, whereby it is also mentioned in this document that suitable lipophilic fluids are readily flowable and non-viscous. However, it has been found that under high-risk conditions it is less safe to apply such a non-viscous and readily flowable fluid in a dry cleaning system.

In view of the foregoing, it is concluded that the dry cleaning systems of the prior art leave to be desired in that the solvent viscosity is generally such that in case of a spill the solvent could easily cover a large surface area in a residential home, possibly even covering multiple floors in the home.

In case of an increased temperature event, a rupture in the dry cleaning system could easily lead to spillage of the cyclosiloxane dry cleaning solvent, such as cyclosiloxane, which could considerably increase the risk of fire.

It is, therefore, an object of the present invention to provide a novel dry cleaning system that addresses one or more of the drawbacks mentioned above. More in particular, it is an object of the invention to provide a dry cleaning system that comprises elements for improving the safety of said system. It is also an object to find a safe dry cleaning method that can be carried out in said system.

It has now surprisingly been found that these objects can be achieved with the dry cleaning method and system of the present invention.

DEFINITION OF THE INVENTION

According to a first aspect, the present invention provides a method for cleaning fabric articles, comprising the step of treating the fabric articles with a working cyclosiloxane dry cleaning solvent to remove contaminants from the articles, wherein the working cyclosiloxane solvent is contacted and mixed with a solidifying catalyst in case of an increased temperature event.

According to a second aspect, the invention provides a a dry cleaning system for cleaning fabric articles suitable for applying the method of the invention, said system comprising:

(a) a reservoir containing the working cyclosiloxane dry cleaning solvent;

(b) a vessel for treating the fabric articles, said vessel being operatively connected to the reservoir, such that, in use, the working cyclosiloxane solvent comes into contact with the fabric articles in the vessel and removes contaminants therefrom, wherein the system additionally contains at least one compartment containing the solidifying catalyst and, optionally, a compartment containing the cross-linking agent, which compartments are located adjacent to the reservoir for the cyclosiloxane dry cleaning solvent or the vessel, and separated therefrom by means of a barrier which opens in case of an increased temperature event.

The present invention provides a safe dry cleaning method and system, because under certain conditions of high risk (as a result of a high temperature event) the viscosity and flashpoint of the cyclosiloxane dry cleaning solvent used in said system/method strongly increase. Furthermore, if the high temperature event would lead to a spillage of the solvent the surface area covered by said solvent will be considerably reduced owing to the strong viscosity increase.

As a consequence, the dry cleaning method and system of the invention are particularly suitable for use in domestic environments.

These and other aspects, features and advantages of the invention will become apparent to those of ordinary skill in the art from a reading of the following detailed description and the appended claims.

For avoidance of doubt, it is noted that the examples given in the description below are intended to clarify the invention and are not given to limit the invention to those examples per se. Other than in the examples, all numbers expressing quantities of ingredients or reaction conditions used herein are to be understood as modified in all instances by the term "about", unless otherwise indicated. Similarly, all percentages are weight/weight percentages of the total composition unless otherwise indicated. Numerical ranges expressed in the format "from x to y" are understood to include x and y. When for a specific feature multiple preferred ranges are described in the format "from x to y", it is understood that all ranges combining the different endpoints are also contemplated.

DETAILED DESCRIPTION OF THE INVENTION

Definitions

The term "dry cleaning process" used herein is intended to mean any process wherein laundry articles are contacted with a dry cleaning composition within a closable vessel. It is to be understood that this is also meant to encompass other fabric treatments such as but not limited to softening and refreshing. However, as used herein this term does not include any process comprising cycles wherein the fabric articles are also immersed and rinsed in an aqueous cleaning composition comprising more than 80% wt of water because this would usually damage garments that can only be dry cleaned.

The term "disposable treatment composition" is intended to mean a composition consisting of one or more surfactants and optionally other cleaning agents.

The term "cyclosiloxane dry cleaning solvent" as used herein is intended to encompass the "working cyclosiloxane dry cleaning solvent" and the "used cyclosiloxane dry cleaning solvent". These are different forms taken on by the cyclosiloxane dry cleaning solvent as it passes through the present system or method during the cleaning and, optionally, the reclamation operation.

The term "dry cleaning composition" as used herein is intended to mean the composition used in the dry cleaning process including the cyclosiloxane dry cleaning solvent, a disposable treatment composition and, optionally, water, but excluding the fabric articles that are to be cleaned.

The term "normal operation" is intended to mean the operation of the dry cleaning system of the invention for the purpose of running a dry cleaning process for treatment of fabric articles.

On the other hand, the term "increased temperature event" is intended to mean the event occurring when the temperature of the environment surrounding the dry cleaning system or the temperature of the cyclosiloxane dry cleaning solvent used in said system exceeds the threshold temperature thereof. The threshold temperature of the solvent is equal to the flash point thereof. Examples of an increased temperature event are fire in the room where the dry cleaning system is located, and overheating of the cyclosiloxane dry cleaning solvent used in said system caused by failure of all temperature controls.

The term "barrier" is intended to mean a structure that separates the working and used cyclosiloxane dry cleaning solvent on the one hand from the solidifying agent and, optionally the cross-linking agent, on the other hand. Said barrier structure is closed under normal operation and is opened by an increased temperature event trigger upon which the separated components are contacted.

A suitable barrier for use in the present invention contains an element selected from a bi-metal, a membrane, a valve and a combination thereof.

The terms "fabric article" and "laundry article" as used herein are intended to mean a garment but may include any textile article. Textile articles include—but are not limited to—those made from natural fibres such as cotton, wool, linen, hemp, silk, and man-made fibres such as nylon, viscose, acetate, polyester, polyamide, polypropylene elastomer, natural or synthetic leather, natural or synthetic fur, and mixtures thereof.

Dry Cleaning Method

The dry cleaning method of the invention may comprise different cleaning and rinsing cycles in any order depending on the desired outcome. The number and length of the cycles may vary depending on the desired result.

For the purpose of the present invention, a rinse cycle is defined as a cycle wherein the laundry articles are agitated in cyclosiloxane dry cleaning solvent only. When surfactant and/or other cleaning agent is present, the cycle is described as a cleaning cycle whereby cleaning is understood to encompass conditioning.

A cycle wherein surfactant and, optionally, other cleaning agent is used will normally comprise of different steps such as mixing a disposable treatment composition with a cyclosiloxane dry cleaning solvent to form a dry cleaning composition, contacting a fabric article with said composition, removing said composition from the fabric article. The removal may be carried out by any means known in the art such as draining, spinning or, when appropriate, evaporating the composition.

Generally, fabric articles are cleaned by contacting a cleaning effective amount of a dry cleaning composition with said articles for an effective period of time to clean the articles or otherwise remove stains therefrom.

Each cleaning cycle may preferably last from at least 0.1 min, or more preferably at least 0.5 min, or still more preferably at least 1 min or even 5 min, and at most 2 hours, preferably at most 30 min, even more preferably at most 20 min. In some cases longer times may be desired, for example overnight.

Usually, the fabric article is immersed in the dry cleaning composition. The amount of dry cleaning composition used and the amount of time the composition is in contact with the article can vary based on the equipment and the number of articles being cleaned. Normally, the dry cleaning method of the invention will comprise at least one cycle of contacting the fabric article with a dry cleaning composition and at least one cycle of rinsing the article with a fresh load of cyclosiloxane dry cleaning solvent.

The mixing of the disposable treatment composition with a cyclosiloxane dry cleaning solvent to form a dry cleaning composition may be carried out by any means known in the art. Mixing may be carried out in a separate chamber or in a drum. Preferably, the disposable treatment composition is mixed with a cyclosiloxane dry cleaning solvent such that the surfactant and, optionally, the other cleaning agent, is effectively dispersed and/or dissolved to obtain the desired cleaning. Suitable mixing devices including pump assemblies or in-line static mixers, a centrifugal pump, a colloid mill or other type of mill, a rotary mixer, an ultrasonic mixer and other means for dispersing one liquid into another, non-miscible liquid can be used to provide effective agitation to cause emulsification.

Preferably, the dry cleaning method is carried out in an automated dry cleaning machine that comprises a closable vessel. Said machine is preferably closed or sealed in such a way that the cyclosiloxane dry cleaning solvent can be contained within the machine if needed. The closable vessel usually comprises a drum which can rotate inside said vessel.

The laundry articles in need of treatment are placed inside the drum wherein said articles are contacted with the dry cleaning composition. This may be done in any way known in the art such as spraying or even using a mist.

Normal Operation

The dry cleaning solvent applied in the method of the invention is a cyclosiloxane solvent. The performance of the dry cleaning step can be further improved by adding a disposable treatment composition the cyclosiloxane dry cleaning solvent, thus creating a dry cleaning composition. After the dry cleaning step of contacting a fabric article with said dry cleaning composition, the used dry cleaning composition is separated from the treated article. Subsequently, the treated fabric article is preferably rinsed in a rinse step by contacting said treated article with an amount of fresh cyclosiloxane dry cleaning solvent. The rinse step ends by separating the used rinse composition from the rinsed fabric article. After the dry cleaning step or the last rinse step whichever is last, the treated or rinsed fabric article is suitably dried by contacting the article with solvent-unsaturated air.

Preferably, the air is heated up to a temperature within the constraints of safe operation of the dry cleaning method of the invention, normally being at least 30° F. below the flash point of the solvent.

After the dry cleaning step, the rinse step and the drying step the separated compositions containing the used cyclosiloxane dry cleaning solvent are preferably transported to a reclamation device where the cyclosiloxane dry cleaning solvent is cleaned up. During said cleaning-up process soils and detergent ingredients are separated from the used cyclosiloxane dry cleaning solvent, resulting in fresh cyclosiloxane dry cleaning solvent for re-use in the method of the invention, particularly the dry cleaning step or the rinse step.

Increased Temperature Event

In case of an increased temperature event the cyclosiloxane dry cleaning solvent is contacted and mixed with a solidifying catalyst and, optionally, with a cross-linking agent, preferably by adding or injecting said catalyst and optionally said agent into the solvent.

As a result, the viscosity and flash point of the solvent are drastically increased.

Beforehand, all cyclosiloxane dry cleaning solvent present in the system can be optionally transported to at least one of the reservoirs for containing the cyclosiloxane dry cleaning solvent.

In case a cross-linking agent is added, the solidifying catalyst and the agent may be added in any order. It is preferred that in between the additions of the catalyst respectively the cross-linking agent the resulting mixture is kept well mixed. It is also preferred that the cross-linking agent be added first to the dry cleaning composition, followed by mixing of the resulting composition, subsequent addition of the catalyst, and again followed by mixing.

Preferably, in case of an increased temperature event the following steps are consecutively triggered:

(i) Optionally, transporting step. In this step, the solvent present in the system is transported to at least one reservoir for containing said solvent or the vessel;
(ii) First contacting step. In this step, the cross-linking agent is contacted with the solvent;
(iii) First mixing step using a stirrer, an extruder, or by purging with an inert gas (e.g. nitrogen gas);
(iv) Second contacting step. In this step, the solidifying catalyst is contacted with the mixture of solvent and cross-linking agent;
(v) Second mixing step. Solidification is further enhanced using the equipment mentioned under above step (iii).

Cyclosiloxane Dry Cleaning Solvent

The cyclosiloxane dry cleaning solvent used in the method of the invention is preferably a cyclic siloxane solvent having a boiling point at 760 mmHg of below about 250° C. This preferred solvent is readily flowable and non-viscous under normal use. Specifically preferred cyclic siloxanes for use in the present invention are octamethyl cyclotetrasiloxane (D4, tetramer), decamethyl cyclopentasiloxane (D5, pentamer), and dodecamethyl cyclohexasiloxane (D6, hexamer). Most preferably, the cyclic siloxane comprises pentamer (D5), and is substantially free of tetramer (D4) and hexamer (D6).

Substantially free means in this connection, that the concentration of D4 and D6 is at most 1% wt of the total mass of cyclosiloxane solvent.

A reclamation process and device are preferably used to clean up the used solvent after a dry cleaning process, for re-use. The capacity of the reclamation process is desirably such that at least part of the used solvent, preferably all, is cleaned up before a new dry cleaning cycle is initiated by the user. Under certain conditions it can be expected that not all used solvent is cleaned-up when the user starts a new dry cleaning cycle, e.g. when one cycle immediately follows the previous one. In view of this, it is preferred to fill the dry cleaning system of the invention with more solvent than needed for one dry cleaning cycle. In this connection, an effective amount of cyclosiloxane solvent is defined to be an amount that is sufficient to run multiple dry cleaning cycles without being hampered by the reclamation capacity of the dry cleaning system.

Preferably, an effective total amount of cyclosiloxane solvent for use in the method of the invention is between 10 kg and 150 kg depending on the load of fabric articles to be cleaned. In other words, said solvent is preferably used in a total amount of 2 to 20 kg per kg wash load to be treated.

Solidifying Catalyst

Non-limiting examples of solidifying catalysts which are suitable for use in the present invention, are:

Basic solidifying catalyst: GX;

Acidic solidifying catalysts: acid clays, HF, $HI_3$, HCl—$FeCl_3$, $H_2SO_4$, $CF_3SO_3H$, wherein, G is an alkali metal, an alkaline earth metal, a quaternary ammonium group, a quaternary phosphonium group, or a phosphazene group. Examples of G are cesium, potassium, sodium, rubidium, strontium, lithium, barium, calcium, magnesium, phosphazene base, $(NZ_4)^+$, $(PZ_4)^+$ where Z is an alkyl radical, selected from methyl, ethyl, propyl or butyl. X is selected from the group of hydroxide, fluoride, alkoxide, alkylsulfide, borate, phosphate, carbonate, silicate, silanolate, carboxylate (comprising an alkyl or an alkylene radical of 1-6 carbon atoms). Additionally, X could be alkyl or polystyryl (when G is Li, Na or K), or poly (trimethylsilylvinyl) (when G is Li).

Preferred solidifying catalysts are strong alkali hydroxides, alkali metal hydroxides, alkali metal alkoxides, alkali metal silanolates, quaternary ammonium hydroxides, sodium hydroxide, potassium hydroxide, cesium hydroxide, rubidium hydroxide, lithium hydroxide, magnesium hydroxide, calcium hydroxide, strontium hydroxide and barium hydroxide, potassium methoxide, potassium oxide, potassium amide, tetramethylammonium methoxide, tetramethylammonium hydroxide, tetrabutylphosphonium silanolate, rubidium carbonate, cesium carbonate, rubidium carbonate, cesium carbonate, rubidium carboxylates, cesium carboxylate, mixtures of alcohols and alkoxides of potassium or sodium (where the alkyl radical has 1-5 carbon atoms, and the mol ratio of alcohol and alkoxide is between 0.5 and 2.5), phosphonitrilic chloride solution (which is obtained from the reaction of two moles of phosphorous pentachloride and one mole of ammonium chloride), phosphazene hydroxide, phosphazene fluoride. More preferably, the solidifying catalyst is cesium hydroxide or phosphazene hydroxide.

Specially preferred solidifying catalysts are phosphazene bases. The phosphazene base reacts with trace quantities of water present to form highly active hydroxide ions which initiate the polymerisation. The phosphazene base will also react with certain other chemical groups which may be present, e.g. silanol or alcohol, to form similarly active polymerisation-initiating species. The phosphazene base may be in ionic form, with a strong anion such as fluoride or hydroxide, which is active in initiating polymerisation.

In principle, any phosphazene base is suitable for use in the present invention. Phosphazene bases have the following core structure P═N—P═N, in which free N valences are linked to hydrogen, hydrocarbon, —P═N or ═P—N, and free P valences are linked to —N or ═N. Some phosphazene bases are commercially available from Fluka Chemie AG, Switzerland. The phosphazene bases preferably have at least 3 P-atoms. Some preferred phosphazene bases are the following general formulae:

$$((R^1R^2N)_3P{=}N{-})_x(R^1R^2N)_{3-x}P{=}NR^3$$

$$[((R^1R^2N)_3P{=}N{-})_x(R^1R^2N)_{3-x}P{-}N(H)R^3]^+[A]^-$$

$$[((R^1R^2N)_3P{=}N{-})_y(R^1R^2N)_{4-y}P]^+[A]^-$$

$$[(R^1R^2N)_3P{=}N{-}(P(NR^1R^2)_2{=}N)_z{-}P^+(NR^1R^2)_3][A]^-$$

where $R^1$ and $R^2$ are each independently selected from the group consisting of hydrogen and an optionally substituted hydrocarbon group, preferably a $C_1$-$C_4$ alkyl group, or in which $R^1$ and $R^2$ together form a heterocyclic ring, preferably a 5- or 6-membered ring; $R^3$ is hydrogen or an optionally substituted hydrocarbon group, preferably a $C_1$-$C_{20}$ alkyl group, more preferably a $C_1$-$C_{10}$ alkyl group; x is 1, 2 or 3, preferably 2 or 3; y is 1, 2, 3 or 4, preferably 2, 3 or 4; z is an integer of from 1 to 10, preferably 1, 2, or 3; and A is an anion, preferably fluoride, hydroxide, silanolate, alkoxide, carbonate or bicarbonate. In particularly preferred compounds, $R^1$ and $R^2$ are methyl, $R^3$ is tert. butyl or tert. octyl, x is 3, y is 4 and A is fluoride or hydroxide. A preferred phosphazene base is phosphazene base-P4-t-bu.

Preferred cationic catalysts comprise a porous, inorganic mineral particulate support, said porous support being coated with a film of polymeric material comprising pendant sulfonic or phosphonic acid functions (preferred particle diameter is 4 mm-5 mm, preferred specific surface area is 5-500 $m^2/g$, preferred average pore diameter of the porous mineral support is 20-3000 Angstrom, and preferred porosity of the porous mineral support is 0.2 to 1.5 ml/g). Examples of other preferred acidic solidifying catalysts are sulphuric acid, sulphonic acid, hydrochloric acid, phosphonitrile halides (sometimes referred to as acidic phosphazenes).

The solidifying catalyst suitable for use in the present invention could be in the form of a liquid. Alternatively, it could be in the form of particulates (10-1000 μm), which could be coated with a cyclosiloxane-wetting film to enhance mixing of the particulates in the amount of cyclosiloxane.

An effective amount of solidifying agent is sufficient to solidify the cyclosiloxane dry cleaning solvent (which is desirably a cyclosiloxane solvent). Preferably, the concentration of solidifying catalyst is between 1 ppm and 10000 ppm by weight based on the total weight of cyclosiloxane dry cleaning solvent applied, more preferably between 3 ppm and 5000 ppm, even more preferably between 5 ppm and 3000 ppm, most preferably between 10 ppm and 1000 ppm.

Cross-Linking Agents

Generally, an effective cross-linking agent for use in the present invention may be a branched silicone based compound comprising at least 1 silicium atom and at least 3 oxygen atoms covalently bonded to said silicium atom.

More in particular, an effective cross-linking agent may be a branched silicone-based compound having the general formula:

$$(R_1O)(R_2O)(R_3O)Si{-}(O{-}Si(OR_4)(OR_5))_xOR_6,$$

wherein $R_1$, $R_2$, $R_3$, $R_4$, $R_5$, and $R_6$ are preferably an alkyl or a siloxane radical, preferably $C_nH_{2n+1}$, wherein n is preferably between 1 and 5, more preferably n is 1 or 2. Preferably, x is less than 50, more preferably less than 20 and most preferably less than 10, but at least 0. The viscosity of an effective cross-linking agent is preferably less than 15 cSt, more preferably less than 10 cSt, most preferably less than 7 cSt. Examples of preferred cross-linking agents are tetraethoxysilane ($Si(OC_2H_5)_4$), poly(diethoxysiloxane), and poly(dimethoxysiloxane).

An effective amount of cross-linking agent is sufficient to cross-link at least 3 silicone radicals. Preferably, the concentration of the cross-linking agent is between 0.05% and 10%, more preferably between 0.1 and 5%, even more preferably 0.1 to 3%, most preferably from 0.2 to 2% by weight, based on the total amount of the cyclosiloxane dry cleaning solvent applied in the method of the invention.

Dry Cleaning System

The dry cleaning system of the invention comprises a reservoir containing the working cyclosiloxane dry cleaning solvent, and a vessel for treating fabric articles, whereby said vessel is operatively connected to the reservoir, such that, in use, the working solvent comes into contact with the fabric articles in the vessel and removes contaminants therefrom.

The system also contains at least one compartment containing the solidifying catalyst and, optionally, a compartment containing the cross-linking agent, which are located adjacent to the reservoir for the solvent or the vessel, and separated therefrom by means of a barrier which opens in case of an increased temperature event.

Preferably, the system of the invention further comprises a reclamation device for cleaning-up the used solvent formed during of the fabric articles in the vessel. When present, this reclamation device is operatively connected with the vessel such that it comes into contact with the used solvent during operation of the system.

It is also desirable that the reclamation device is operatively connected to the reservoir for the working cyclosiloxane dry cleaning solvent such that the cleaned-up solvent can be re-used for treating the fabric articles.

Furthermore, when a reclamation device is present it is preferred that the system further comprises a reservoir for the used solvent which is operatively connected to the vessel and said reclamation device. In such case, it is also preferred that the compartment containing the solidifying catalyst, and, optionally, the compartment containing the cross-linking agent, are located adjacent to the vessel, the reservoir for the working solvent and/or the reservoir for the used solvent, and that these compartments are separated therefrom by means of a barrier which opens in case of an increased temperature event.

In view of all these safety measures, the dry cleaning system of the invention is desirably suitable for in-home use.

Figure 2:
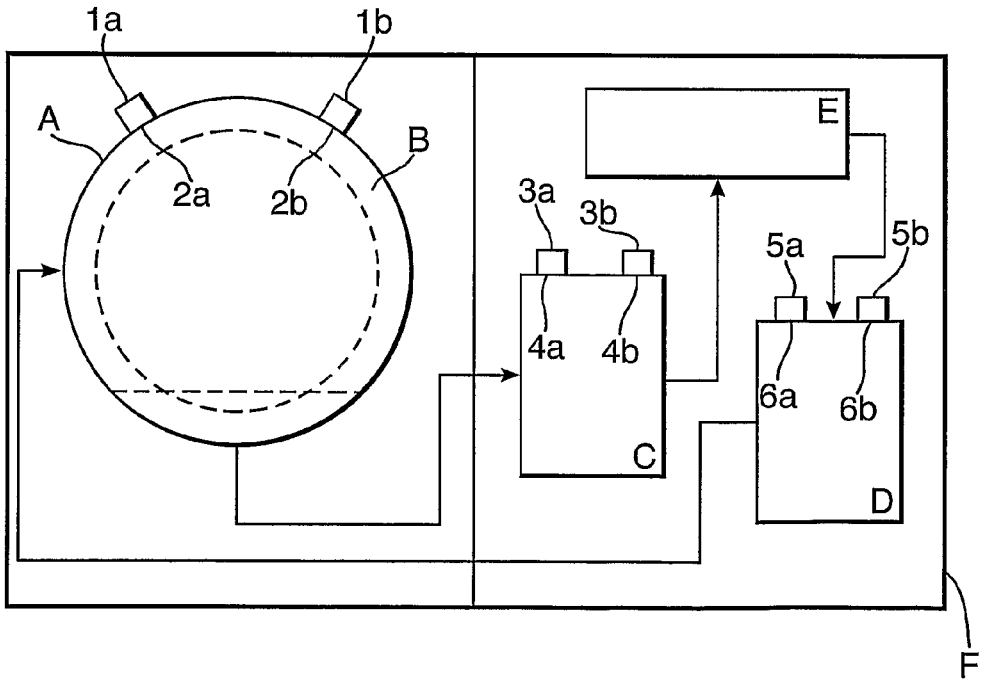

The present invention is illustrated by FIGS. 1 and 2, each of which showing an in-home cyclosiloxane-based dry cleaning system including compartments containing a solidifying catalyst and a cross-linking agent. In view of their configuration, the safety of these systems is significantly improved as compared to systems of the prior art.

In normal use, the dry cleaning systems shown in both FIGS. 1 and 2, are operated as follows. Working cyclosiloxane solvent is transported from reservoir (D) to vessel (A) for dry cleaning fabric articles which are contained in drum (B). Said dry cleaning method is optionally carried out using a dry cleaning composition comprising the working solvent and a disposable treatment composition. The used cyclosiloxane solvent formed as a result of the fabric treatment is transported to the used solvent reservoir (C). From the reservoir, the used solvent is further transported to a reclamation device (E) where it is cleaned-up such that it can be used again for a subsequent cycle. The cleaned-up cyclosiloxane solvent is transported to reservoir (D).

It follows that during normal operation cyclosiloxane solvent is present in reservoirs (C) and (D), and in vessel (A). Other examples of containers/locations where cyclosiloxane solvent may be present are optional storage tanks, piping (not shown in detail in the Figures) and the sealed outer casing of the total dry cleaning system (F).

The system shown in FIG. 1 also includes compartments (1*a*) and (1*b*) containing solidifying catalyst respectively cross-linking agent, said compartments being separated from vessel A by way of barriers (2*a*) and (2*b*).

The system shown in FIG. 2 includes additionally compartments (3*a*), (3*b*), (5*a*) and (5*b*), which compartments are separated from reservoirs (C) and (D) by way of barriers (4*a*), (4*b*), (6*a*) and (6*b*). Compartments (3*a*) and (5*a*) contain solidifying catalyst, whereas compartment (3*b*) and (5*b*) contain cross-linking agent. In case of an increased temperature event, the barriers open and the cyclosiloxane solvent comes into contact with the catalyst and the cross-linking agent, which results in a solidifying mixture. As a further result, the viscosity and the flash point of the cyclosiloxane solvent are increased considerably.

In the preferred embodiment shown in FIG. 1, it can be noticed that the compartments containing the solidifying catalyst and the cross-linking agent are located at the upper side of vessel (A).

In case of an increased temperature event, first all cyclosiloxane solvent present in the system is transported to vessel (A). This transportation may be carried out by pumping, by gravitational forces, or by any other suitable method of transportation (not shown in FIG. 1). Subsequently, the barrier (2*b*) between the cross-linking agent compartment (1*b*) and the vessel (A) is opened, followed by contacting the solvent present in vessel (A) with said agent. Subsequently, the barrier (2*a*) between the solidifying catalyst compartment (1*a*) and the vessel (A) is opened, followed by contacting and mixing said catalyst with the mixture of solvent and cross-linking agent in vessel (A). The resulting solidifying process may be enhanced by thoroughly mixing the resulting material in vessel (A).

This can be done e.g. by rotating drum (B) and/or by purging this material with inert gas (such as nitrogen).

When present, this inert gas is stored in a compartment at the bottom side of the vessel (A) (not shown in FIG. 1) and is released by opening of a barrier, which is triggered by the increased temperature event.

FIG. 2 shows another preferred embodiment of the system of the invention. It can be noticed that similarly to the system of FIG. 1 the compartments for the solidifying catalyst and the cross-linking agent are positioned at the upper side of the vessel (A), and the reservoirs (C) and (D).

In the embodiment of FIG. 2, the cyclosiloxane solvent remains in the vessel (A) and the reservoirs (C) and (D) in case of an increased temperature event and the barriers (2*b*), (4*b*) and (6*b*) are opened, thus allowing the solvent to be contacted with the cross-linking agent.

Subsequently, the barriers (2*a*), (4*a*) and (6*a*) are opened, which results in mixing of the solvent with the solidifying catalyst and the cross-linking agent.

Similarly as in the embodiment of FIG. 1, the solidifying process may be enhanced by purging the resulting mixture with an inert gas (such as nitrogen).

Figure 3:
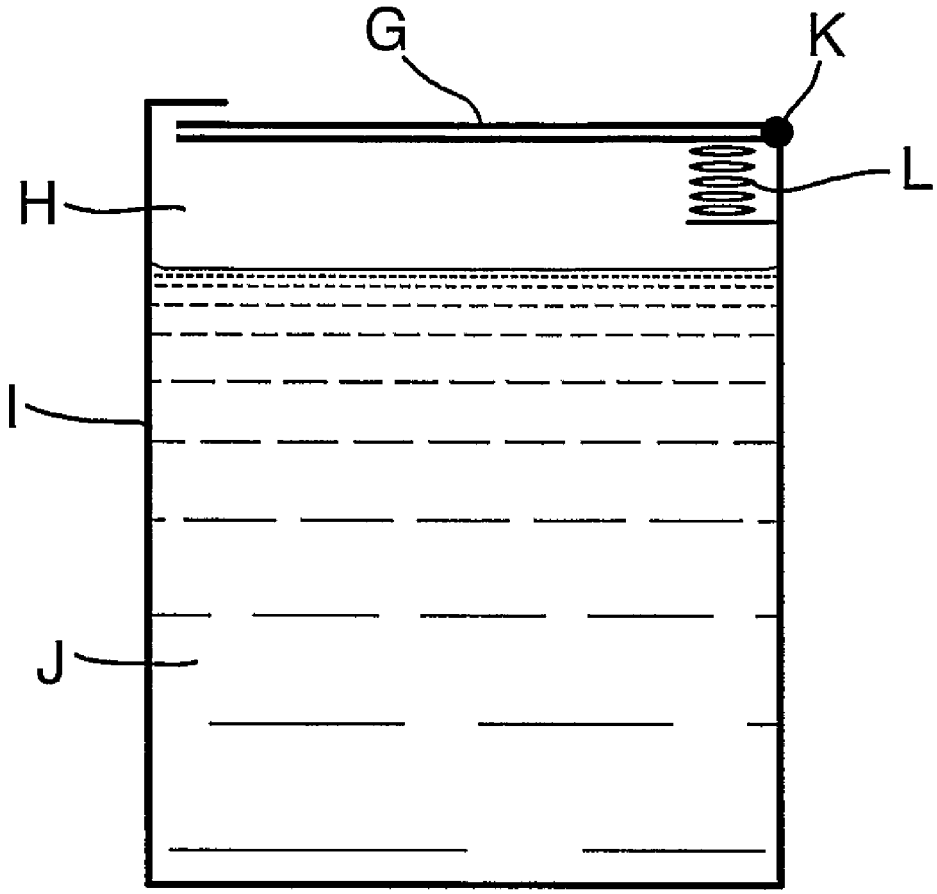

FIG. 3 shows a preferred embodiment of a compartment (I) containing solidifying catalyst or cross-linking agent. As is shown in this FIG. 3, the compartment (I) is mainly filled with catalyst or agent (J) leaving a headspace ((H). This head space is filled with an inert gas of which pressure builds up when its temperature increases.

Furthermore, a barrier is present containing a bi-metal lid (G), a hinge (K) and a spring (L). Since the top part of the bi-metal lid (G) expands more than the bottom part thereof as a result of a temperature increase, the shown barrier configuration will open in case of an increased temperature event.

The present invention is illustrated by the following non-limiting examples.

EXAMPLES 1-5

A 100 ml beaker glass (diameter: 5 cm) was filled with 50 g cyclosiloxane solvent (i.e. decamethylcyclopentasiloxane, ex Dow Corning) and a magnetic stirrer bar (length 2 cm) was added. Subsequently, the beaker glass was heated up to 75° C. and well mixed by placing it on a combined heater and magnetic stirrer (IKA RCT Basic). Then, varying amounts of first a cross-linking agent (tetraethoxysilane, ex Aldrich) and subsequently a solidifying catalyst (Phosphazene base-P4-t-bu, ex Fluka) were added. After addition of both the agent and the catalyst the contents of the beaker glass were stirred.

In the table below, the tested compositions and times to solidify these compositions are shown, whereby the indicated levels of catalyst and agent are based on the weight of the solvent present:

| Example | Solidifying catalyst (ppm) | Cross-linking agent (w/w %) | Time to solidify[1] (min) |
|---|---|---|---|
| 1 | 1300 | 0 | 0.8 |
| 2 | 130 | 0.1 | 3.5 |
| 3 | 1300 | 0.1 | 0.75 |
| 4 | 6300 | 0.1 | 0.5 |
| 5 | 130 | 0.9 | 0.8 |

[1]Reflects the time between the moment immediately after the catalyst has been added and the moment the composition has solidified (when the stirrer bar has stopped stirring due to high viscosity).

There is a clear relation between the time to solidify and on the other hand the level of solidifying catalyst and cross-linking agent in the cyclosiloxane solvent. As shown in the above table, the time to solidify the composition becomes shorter with increasing levels of the catalyst, at lower levels of cross-linking agent

The invention claimed is:

1. A method for conducting a safe dry cleaning process for cleaning fabric articles in a dry cleaning system, comprising the steps of:

treating the fabric articles with a working cyclosiloxane dry cleaning solvent in the dry cleaning system to remove contaminants from the articles, the working cyclosiloxane dry cleaning solvent having a pre-determined flash point temperature; and adding a solidifying catalyst into the working cyclosiloxane dry cleaning solvent and fabric articles and wherein the temperature of the environment surrounding the dry cleaning system or the temperature of the dry cleaning solvent exceeds the predetermined flash point temperature of the working cyclosiloxane dry cleaning solvent, during an increased temperature event.

2. The method according to claim 1, further comprising the step of:

adding a cross-linking agent into the working cyclosiloxane dry cleaning solvent and wherein the temperature of the environment surrounding the dry cleaning system or the temperature of the working cyclosiloxane dry cleaning solvent exceeds the predetermined flash point temperature.

3. The method according to claim 1, wherein:

a used cyclosiloxane dry cleaning solvent is formed as a result of the fabric treatment and is separated from the fabric articles and cleaned-up in a reclamation device of the dry cleaning system; and the method further comprising the step of adding solidifying catalyst into the used cyclosiloxane dry cleaning solvent and wherein the temperature of the environment surrounding the dry cleaning system or the temperature of the dry cleaning solvent exceeds the predetermined flash point temperature.

4. The method according to claim 3, wherein the used cyclosiloxane dry cleaning solvent is cleaned in the reclamation device and is used as the working cyclosiloxane dry cleaning solvent.

5. The method according to claim 2, wherein the working cyclosiloxane cyclosiloxane dry cleaning solvent is first contacted by the cross-linking agent, and subsequently contacted by the solidifying catalyst.

6. The method according to claim 1, wherein the method further comprises:

transporting the working cyclosiloxane dry cleaning solvent into a vessel of the dry cleaning system prior to adding the solidifying catalyst.

7. The method according to claim 1, wherein the working cyclosiloxane dry cleaning solvent is a cyclosiloxane solvent.

8. The method according to claim 1, wherein the working cyclosiloxane dry cleaning solvent is decamethyl cyclopentasiloxane (DS).

9. The method according to claim 1, wherein the working cyclosiloxane dry cleaning solvent is used in a total amount of from 10 kg to 150 kg depending on the load of fabric articles to be cleaned.

10. The method according to claim 1, wherein the solidifying catalyst is selected from a strong acid or a strong base.

11. The method according to claim 1, wherein the solidifying catalyst is an alkali metal.

12. The method according to claim 1, wherein the solidifying catalyst is a phosphazene base.

13. The method according to claim 1, wherein the solidifying catalyst is used at a concentration of from 3 to 5000 ppm, based on the total weight of cyclosiloxane dry cleaning solvent applied.

14. The method according to claim 2, wherein the cross-linking agent is a branched silicone based compound comprising at least 1 silicium atom and at least 3 oxygen atoms covalently bonded to said silicium atom.

15. The method according to claim 14, wherein the cross-linking agent is selected from the group consisting of poly (diethoxysiloxane), poly (dimethoxysiloxane) and tetraethoxysilane.

16. The method according to claim 2, wherein the cross-linking agent is used at a concentration of from 0.05% to 10% by weight based on the total weight of working cyclosiloxane dry cleaning solvent applied.

17. The method according to claim 1, wherein the fabric articles are treated with a cleaning composition comprising the working cyclosiloxane dry cleaning solvent and a disposable treatment composition.

18. The method according to claim 1, further comprising the step of:

forming a used cyclosiloxane dry cleaning solvent during the fabric treatment; and adding a cross-linking agent into the working cyclosiloxane dry cleaning solvent and the used cyclosiloxane dry cleaning solvent after adding the solidifying catalyst.

19. The method according to claim 1, wherein the solidifying catalyst is an alkaline earth metal hydroxide.

20. The method according to claim 1, wherein the solidifying catalyst is selected from the group consisting of potassium, sodium, lithium, cesium and rubidium.

21. The method according to claim 1, wherein:

the dry cleaning system comprises a vessel having a barrier; and the method further comprising the step of opening the barrier prior to adding the solidifying catalyst to the working cyclosiloxane dry cleaning solvent.

22. A method for conducting a safe dry cleaning process for cleaning fabric articles in a dry cleaning system, comprising the step of:

adding a solidifying catalyst into the dry cleaning system containing working cyclosiloxane dry cleaning solvent having a predetermined flash point temperature and wherein the temperature of the environment surrounding the dry cleaning system or the temperature of the dry cleaning solvent exceeds the predetermined flash point temperature of the solvent, during an increased temperature event.

23. The method according to claim 22, further comprising the step of:

adding a cross-linking agent into the working cyclosiloxane dry cleaning solvent and wherein the temperature of the environment surrounding the dry cleaning system or the temperature of the working cyclosiloxane dry cleaning solvent exceeds the predetermined flash point temperature.

24. The method according to claim 23, wherein the cross-linking agent is a branched silicone based compound comprising at least 1 silicium atom and at least 3 oxygen atoms covalently bonded to said silicium atom.

* * * * *